US011117036B2

(12) United States Patent
Gray

(10) Patent No.: US 11,117,036 B2
(45) Date of Patent: Sep. 14, 2021

(54) TACKLE BAG

(71) Applicant: Richard John Gray, Galashiels (GB)

(72) Inventor: Richard John Gray, Galashiels (GB)

( * ) Notice: Subject to any disclaimer, the term of this patent is extended or adjusted under 35 U.S.C. 154(b) by 0 days.

(21) Appl. No.: 16/570,023

(22) Filed: Sep. 13, 2019

(65) Prior Publication Data

US 2020/0086195 A1 Mar. 19, 2020

(30) Foreign Application Priority Data

Sep. 13, 2018 (GB) ..... 1814888

(51) Int. Cl.
*A63B 69/34* (2006.01)

(52) U.S. Cl.
CPC ..... *A63B 69/345* (2013.01); *A63B 2209/00* (2013.01); *A63B 2243/0066* (2013.01)

(58) Field of Classification Search
CPC ..... A63B 69/345; A63B 2209/00; A63B 2243/0066
USPC ..... 473/422, 438, 439, 441–445
See application file for complete search history.

(56) References Cited

U.S. PATENT DOCUMENTS 2,967,709 A * 1/1961 Stahley ..... A63B 69/345 473/441
3,033,151 A * 5/1962 Sheehan ..... E02B 3/26 114/219
4,103,889 A * 8/1978 Lobur ..... A63B 69/201 482/86
9,174,108 B2 * 11/2015 Siklosi ..... A63B 69/20 482/83
9,393,476 B2 * 7/2016 Arena ..... A63B 69/345 473/444
D794,729 S * 8/2017 Johnson ..... D21/698
10,561,920 B2 * 2/2020 Wagner ..... A63B 69/345 482/83
2008/0008984 A1 * 1/2008 McDonald ..... A63B 71/06 434/247
2008/0254950 A1 * 10/2008 Beliles ..... A63B 69/004 482/83
2015/0258408 A1 * 9/2015 Arena ..... A63B 69/345 473/444
2017/0203178 A1 * 7/2017 Gray ..... A63B 69/345 473/441
2020/0086195 A1 * 3/2020 Gray ..... A63B 69/345 473/441
2020/0101362 A1 * 4/2020 Adkisson ..... A63B 69/345 473/444

* cited by examiner

*Primary Examiner* — Mitra Aryanpour
(74) *Attorney, Agent, or Firm* — Blue Filament Law PLLC

(57) ABSTRACT

A training apparatus for use in tackle training, comprises an elongate contact pad having a front surface; and at least two laterally extending elongate members disposed in general longitudinal alignment with the elongate contact pad, wherein the laterally extending elongate members are disposed to the rear of the elongate contact pad, which provides an effective training apparatus for improvements in collisions, tackles and especially the 'grapple' tackle in rugby, thereby improving point of contact, height of approach and arm grip strength.

25 Claims, 3 Drawing Sheets

TACKLE BAG

FIELD OF THE INVENTION

This invention pertains generally to the field of sports training equipment and in particular to articles and apparatus to facilitate training in the tackle and collision area of rugby and other sports. More particularly, the invention relates to device for use as a tackle training apparatus, such as a tackle bag for collision and tackling training purposes, to a method of training and to a method of manufacture.

BACKGROUND OF THE INVENTION

Aids to facilitate tackling and the collision area of sports, such as the game of rugby, exist in the form of tackle bags of cylindrical form which may stand on the ground, optionally supported by a coach, for use by someone training in the sport to tackle, in the form of collision shields fitted with straps to be held by a coach and tackled by someone training in the sport.

A disadvantage of the existing art is that the articles are limited in their function. Other more sophisticated apparatus is available in the form of steel frame devices with padded portions for particular training exercises. These typically have a disadvantage in terms of cost to purchase but also limited functionality.

The present inventor has invented a new training device for use in rugby or other collision sport training.

Problem to be Solved by the Invention

There is a need for improvements in sports training devices which improve the versatility and specificity of rugby training articles for the tackle.

It is an object of this invention to provide an article for facilitating sports training that is versatile, low-cost, efficient to manufacture and adaptable for use in a range of training exercises with tackle bags.

SUMMARY OF THE INVENTION

In accordance with a first aspect of the invention, there is provided a training apparatus for use in tackle training, the apparatus comprising: an elongate contact pad having a front surface; and at least two laterally extending elongate members disposed in general longitudinal alignment with the elongate contact pad, wherein the laterally extending elongate members are disposed to the rear of the elongate contact pad.

In a second aspect of the invention, there is provided a method of training in the tackle of Rugby and other contact or collision sports, the method comprising providing a training apparatus as defined above, attempting to tackle the apparatus by approaching the apparatus toward the elongate contact pad whilst the apparatus is in an upright configuration, planting a shoulder against a front surface of the elongate contact pad with the head to either side thereof whilst wrapping and holding the arms and hands about laterally disposed elongate members, maintaining the hold about laterally disposed elongate members during contact and whilst attempting to topple and floor the apparatus and optionally for a period after flooring the apparatus and then releasing.

In a third aspect, there is provided a method of manufacturing an apparatus for use in tackle training, the method comprising providing an elongate or cylindrical resiliently compressible foam member, providing a fabric and polymer cover for the foam member, providing at least two laterally extending elongate members or elongate cylinders of resiliently compressible foam, providing a fabric and polymer cover for the two laterally extending elongate members, optionally providing a core support member and fabric and polymer cover for the core support member, affixing the covers for the elongate or resiliently compressible foam member and the two laterally extending elongate members to the cover for the core support member along respective sides thereof and fitting the covers over the elongate or resiliently compressible foam member, the two laterally extending elongate members and the core support member.

Advantages of the Invention

The sports training apparatus of the invention provides an effective training apparatus for improvements in collisions, tackles and especially the 'grapple' tackle in rugby. Use of the apparatus facilitates improvement in point of contact, height of approach and arm grip strength, for example.

DETAILED DESCRIPTION OF THE INVENTION

Figure 1:
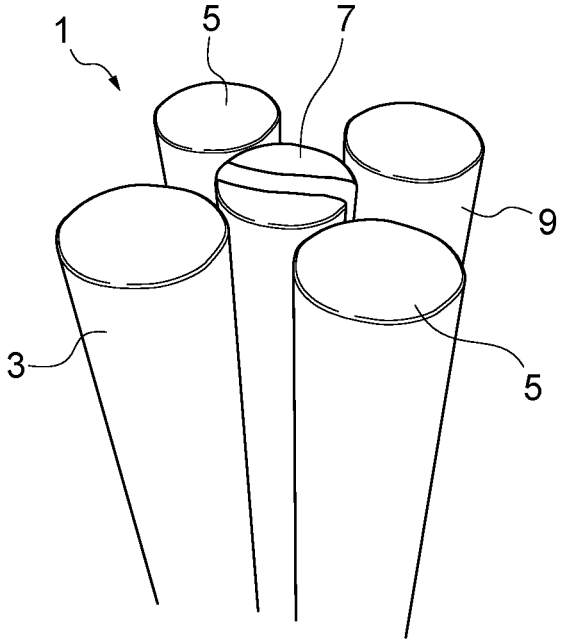
FIG. 1 illustrates in top perspective view an upper portion of a collision training apparatus according to one embodiment of the invention.

The training apparatus according to the invention is for use in tackle training and especially for use in collision training for rugby, such as a tackle in rugby known as 'grapple' whereby a tackler will move and ground and opponent with arms wrapped about a user. However, it can be used in training any contact, collision and grip manoeuvre in a contact sport.

The training apparatus comprises an elongate contact pad having a front surface or front contact surface, being the pad for primary initial contact in the tackle. It further comprises at least two laterally extending elongate members disposed in generally longitudinal alignment with the elongate contact pads. The laterally extending elongate members are disposed to the rear of the elongate contact pad, where the rear of the elongate contact pad is taken to be the opposing side to the front or contact surface which the user would aim to contact with.

By general longitudinal alignment, it is meant that the longitudinal axes of the laterally extending elongate members and the elongate contact pads are generally in alignment, such as by being disposed relative to one another within an angle of 30°, preferably within 15°, more preferably within 10° and most preferably parallel to one another.

By laterally extending elongate members, it is meant that the elongate members are disposed such that they extend laterally further than the width or lateral extent of the elongate contact pad, which includes being disposed so that they extend laterally further than the width of the elongate contact pad.

Preferably, the elongate contact pad has a lateral width and the two laterally extending elongate pads are disposed such that each extends laterally beyond the elongate contact pad and preferably both laterally extending elongate members are disposed so that together they extend laterally beyond the elongate contact pad.

The function of the apparatus according to a preferred embodiment and further aspect of the invention is in rugby training and in particular improving technique in tackles, mauls and collisions in rugby and especially in relation to the wrap and grip technique in the tackle maul or other collisions in rugby, such as in Rugby Union or Rugby League, although it can be used in any contact or collision based sport where a wrap and grip technique may be effective. In use, the user aims to contact a front surface of the elongate contact pad with their shoulder with their head to one side of the other and wrap their arms about the laterally extending elongate members and attempt to grip or hold the position in the course of moving and/or toppling and flooring or grounding the apparatus. In use, the tackle or contact is made to the apparatus in an upright configuration, in which the elongate contact pad and laterally disposed elongate members are disposed in a generally upright configuration and preferably vertical orientation.

Preferably, the two laterally extending elongate members are disposed to define a cumulative lateral extent of at least 1.25× a width of the elongate contact pad, preferably at least 1.5×, preferably no more than 4× the width and typically from 1.75 to 3.5× the width, preferably up to 3.25× the width e.g. from 1.8 to 2.2× the width. Preferably, the cumulative lateral extent of the two laterally disposed elongate members as disposed in the apparatus is at least 40 cm (15.75 in), more preferably at least 50 cm (19.69 in), typically no more than 80 cm (31.50 in), more preferably no more than 70 cm (27.56 in) and most preferably from 55 (21.65 in) to 65 cm (25.60).

The two laterally extending elongate members are preferably centered about a position (or disposed in a plane preferably laterally bisecting the two laterally extending elongate members) at least 20 cm (7.87 in) to the rear of the front surface of the elongate contact pad, preferably at least 25 cm (1.97 in) to the rear, more preferably at least 30 cm (11.81 in), preferably no more than 50 cm (19.69 in), more preferably in the range 35 (13.78 in) to 45 cm (17.72 in), e.g. 38 (14.90 in) to 42 cm (16.53 in) and most preferably about 40 cm (15.75 in) to the rear of the front surface of the elongate contact pad.

Preferably, the two laterally extending elongate members have a depth (e.g. an average depth) from front to rear, in a portion laterally disposed beyond the elongate contact pad, of at least 10 cm (3.93 in), preferably at least 15 cm (5.91 in) and more preferably no more than 25 cm (9.84 in), e.g. 18 (7.09 in) to 22 cm (8.66 in). This size is preferred so that it is not so easy to grip and can only be gripped with a large and open grip. Part of the technique being trained is to be able to maintain this grip as would be necessary on a competitors arm or leg during a tackle in play.

The two laterally disposed elongate members may be discrete elongate members that are optionally inter-connected with one another, e.g. via an intermediary member or a core support member, or may be parts or portions of a single unitary member. Preferably, the laterally disposed elongate members are discrete elongate members.

Optionally, the laterally disposed elongate members may be attached or affixed to the contact pad or to a rearward projecting portion of the contact pad.

Preferably the training apparatus further comprises a core support member, which is preferably an elongate core member. Preferably, the two laterally disposed elongate members are disposed adjacent to and preferably linked or secured to the core support member. Preferably, the contact pad is adjacent to and preferably linked or secured to the core support member. The core support member is preferably disposed to the rear of the elongate contact member and adjacent to or linked or secured to the elongate contact member along a surface opposing the front contact surface of the elongate contact pad. Preferably, the core support member is an elongate member and defines a longitudinal axis generally aligned with that of the elongate contact pad and/or the two laterally disposed elongate members.

Preferably, the core supporting member has a depth, from front to back, of from of at least 10 cm (3.94 in), preferably at least 15 cm (5.91 in) and more preferably no more than 40 cm (15.75 in), preferably at least 18 cm (7.09 in) and in one embodiment no more than 25 cm (9.84 in), such as from 18 (7.09 in) to 22 cm (8.66 in), and in another embodiment at least 20 cm (7.87 in), preferably at least 25 cm (9.84 in), such as from 28 (11.02 in) to 35 cm (13.78 in).

In a preferred embodiment, the elongate contact pad has a lateral width of at least 15 cm (5.91 in), more preferably at least 18 cm (7.09 in). Preferably, it has a lateral width of up to 50 cm (19.69 in), preferably up to 40 cm (15.75 in). In one embodiment, it has a width in the range 17 (6.69 in) to 23 cm (9.055 in). In another, preferred embodiment, it has a width of at least 20 cm (7.87 in), more preferably 25 cm (9.84 in) and still more preferably in the range 28 (11.02 in) to 35 cm (13.78 in). The width of the elongate contact pad is preferably configured to mimic the chest or torso of a typical adult rugby player so as to develop technique and shape in training that is relevant to real game play.

In a preferred embodiment, the laterally disposed elongate members are absent any readily gripable features or protrusions, Preferably, there is provided a plurality of gripping features, which may be disposed on the surface or within the surface (permanently or removably).

Preferably, at least the elongate contact pad is a padded member. Preferably the two laterally disposed elongate members are padded.

The elongate contact pad may be of any suitable shape and may be irregular in shape, but is preferably a prism. The prism may be of any suitable cross section, such as triangular, square, pentagonal, hexagonal, heptagonal or octagonal. Preferably, the elongate contact pad is cylindrical.

The two laterally disposed elongate members may be of any suitable shape and may be irregular in shape, but are preferably prisms. The prisms may be of any suitable cross section, such as triangular, square, pentagonal, hexagonal, heptagonal or octagonal. Preferably, the two laterally disposed elongate members are cylindrical.

Preferably, the elongate contact pad and the two laterally disposed elongate members are cylindrical.

Preferably, in embodiments in which the apparatus comprises a core supporting member, it is an elongate member of any suitable shape, may be irregular in shape or regular, but is preferably a prism. The prism may be of any suitable cross section, such as triangular, square, pentagonal, hexagonal, heptagonal or octagonal. Preferably, the core supporting member is cylindrical.

Preferably the apparatus comprises at least one stabilizing member for facilitating stability of the apparatus when upright. There may be one or more stabilizing member and preferably one. The at least one stabilizing member is preferably disposed to the rear of the elongate contact pad and preferably also to the rear of the core supporting member. Preferably the at least one stabilizing member is adjacent to and associated with or affixed to the core supporting member. Preferably, the at least one stabilizing member is an elongate member. The at least one stabilizing member may be of any suitable shape and may be irregular in shape or regular, but is preferably a prism. The prism may be of any suitable cross section, such as triangular, square, pentagonal, hexagonal, heptagonal or octagonal. Preferably, the stabilizing member is cylindrical.

In a preferred embodiment of the apparatus of the invention, each of an elongate contact pad member and two laterally extending elongate members and optionally an elongate core member and further optionally an elongate stabilizing member are cylindrical or at least partly cylindrical (e.g. majority cylindrical).

In one embodiment, the training apparatus comprises one or more of an elongate contact pad member, two laterally extending elongate members and an elongate core member and wherein two or more and preferably all of them are in fixed relationship relative to one another according to one embodiment, and wherein two or more of them and preferably all of them are mobile or moveable relative to one another in the apparatus, e.g. within a flexible outer coating or flexible case.

Optionally, the one or more of an elongate contact pad member, two laterally extending elongate members and an elongate core member may be a unitary member. Preferably, they are instead discrete members.

The apparatus may provide, for the elongate contact pad member, two laterally extending elongate members and elongate core member a single flexible outer coating or outer cover. Alternatively, the elongate contact pad member, two laterally extending elongate members and an elongate core member and preferably all of them are each provided with an individual flexible outer coating or flexible cover. Preferably, the covered elongate contact pad member, two laterally extending elongate members and/or elongate core member are secured together, e.g. stitched together.

The elongate body usable in any of the above aspects or embodiments may be formed of any suitable material that is suitable for receiving contact or collisions. Typically, the elongate body comprises an outer pad that may be, for example, a shaped cover (e.g. of leather or synthetic leather, such as PVC, or textile or fabric, as is known in the art) filled with an appropriate filler (e.g. fibrous filler, fabrics, wool, reconstituted foam or shaped foamed plastic filler), or may be for example a shaped pad of resilient or resiliently compressible foam material (e.g. polyurethane) coated with a synthetic coating material or a cover (of, e.g. leather or synthetic leather, such as PVC, or textile or fabric, as is known in the art). Preferably the coating material is a laminate such as a woven or textile fabric with a PVC coating.

In a preferred embodiment, the elongate contact pad member, two laterally extending elongate members and elongate core member are all cylindrical.

Preferably, the elongate contact pad member, two laterally extending elongate members and elongate core member are all formed of a resiliently compressible foam material, e.g. in a cylindrical shape, preferably disposed in a cover.

The height of the apparatus and the height of the elongate contact pad and one or more, preferably all, of the two laterally disposed elongate members, optional core supporting member and optional stabilizing member, is preferably from 50 (19.69 in) to 200 cm (78.74 in), more preferably from 60 (23.62 in) to 180 cm (70.87 in). In one embodiment, of a relatively short apparatus, the height is from 60 (23.62 in) to 80 cm (31.50 in), more preferably 65 (25.59 in to 75 cm (29.53 in). In another embodiment, of a medium height apparatus, the height is preferably from 100 (39.37 in) to 120 cm (47.24 in), preferably 105 (41.34 in) to 115 cm (45.28 in). In one embodiment, of a tall apparatus, the height is from 130 (51.18 in) to 150 (59.05 in), preferably 135 (53.15 in) to 145 cm (57.09 in). In a very tall apparatus, the height is from 150 (59.05 in) to 170 (66.93 in), preferably from 155 (61.02 in) to 165 cm (65.97 in).

In a preferred embodiment (and further aspect of the invention), the apparatus comprises an arrangement of five prismic, preferably cylindrical, members, each prismic, preferably cylindrical, member mounted adjacent to at least one other prismic, preferably cylindrical, member, wherein at least one prismic, preferably cylindrical member, is preferably an elongate contact pad and at least two prismic, preferably cylindrical, members are preferably at least two laterally extending elongate members. Preferably, one of the prismic, preferably cylindrical, members is a core supporting member. Preferably, the elongate contact pad or the core supporting member has the largest diameter and more preferably the elongate contact pad.

In one embodiment and in a further aspect of the invention, a training apparatus comprises one or more of an elongate contact pad member, two laterally extending elongate members and an elongate core member, wherein one or more of the elongate contact pad, the two laterally extending elongate members and the elongate core member comprises one or more of:

A) a movable guiding flange member disposed about the surface of at least one of the elongate members, preferably the elongate contact pad, which flange is capable of being moved to multiple longitudinal positions along the length of the one or more elongate members;

B) an elongate enclosed cavity within the one or more elongate members, which cavity contains or may contain a mobile material occupying a portion of the cavity; and C) an interchangeable core, core assembly or internal layer of the one or more elongate members whereby the elongate member is configured such that one or more core elements or internal layers may be removed from the elongate member and substituted with alternative core elements or internal layers having alternative features.

In one embodiment, an apparatus according to the present invention may comprise a movable guiding flange member disposed about the surface of the elongate contact pad which is capable of being moved to multiple longitudinal positions along the length of the elongate contact pad. The guiding flange may be of any suitable size to fit about the circumference of the elongate contact pad at various points along its length so as to define a target tackling zone (e.g. a low target tackling area, a medial target tackling area or a high target tackling area). When fitted to the elongate contact pad, the guiding flange should preferably rest in selected position without support, so that it can be positioned and then used at that position in training.

Preferably, the guiding flange, in use, should project outwards from the front and preferably side surfaces of the elongate contact pad to an extent to define a tackle area such that in use it is apparent if the target area has not been properly targeted. Preferably, it projects outward from the or each respective surface of the elongate contact pad by from 5 (1.97 in) to 30 cm (11.81 in), more preferably at least 8 cm (3.15 in), e.g. from 10 (3.94 in) to 25 cm (9.84 in). In one embodiment, it may project outward by at least 15 cm (5.91 in), and most preferably about 20 cm (7.87 in). In another more preferred embodiment, it projects outwards by up to 15 cm (5.91 in), say 11 (4.33 in) to 13 cm (5.12 in) and preferably about 12 cm (4.72 in).

The guiding flange may have any suitable length (i.e. extent along a longitudinal direction defined by the elongate contact pad of the apparatus), but is preferably at least 3 cm (1.18 in), more preferably at least 5 cm (1.97 in) and up to 20 cm (7.87 in), more preferably 5 (1.97 in) to 15 cm (5.91 in), more preferably 7 (2.76 in) to 11 cm (4.33 in) e.g. about 8 cm (3.15 in) or about 10 cm (3.94 in).

The guiding flange may remain in a position on the elongate contact pad by, for example, being a snug fit to the elongate contact pad or by way of fixings such as snap fit fixings or hook and loop fixing (e.g. Velcro™).

The guiding flange may be a multi-part device forming a partial ring or parts of a partial ring still securable to define regions on the elongate contact pad.

In a one embodiment the apparatus comprises a core assembly which may be adapted to alter the properties or behaviour of the apparatus. Optionally, the core assembly may be removable and interchangeable to facilitate a range of weights or dynamic or other properties. The inter-changeable core assembly may comprise one interchangeable core component or a plurality of interchangeable core components (e.g. a central longitudinal core and one or more inner layers).

An interchangeable core component or central core may comprise or be interchanged with a foam core member (which is typically a cylindrical member) or a denser foam core member or a weight (e.g. a steel bar) or a container (e.g. for containing a mobile material).

In an embodiment where a core assembly comprises a central core and one or more concentric or coaxial tubular or inner layers, each may be interchanged with other core or tubular members or together may interchanged with a larger component (such as a large foam core or a container defining a cavity) so as to achieve desired properties.

In an embodiment of the invention comprising an interchangeable core assembly in an elongate member of the apparatus, the elongate member comprising an elongate medial body portion having a, preferably padded, end portion disposed on each end, at least one of the end portions being removable and rejoinable so as to allow access to a core assembly. The medial body portion (which defines the larger portion of the side surface of the elongate body member) comprises (other than a coat or coating disposed on the exterior surface) a side padding portion having a radial extent of less than the radius of the body portion and defining an internal cavity (which optionally is lined with a different material, such as a plastic or fabric coating on the internal surface of the side padding portion or a rigid thin tube of plastic or metal) and disposed within the internal cavity a core assembly, which as described above may comprise a single core component or multiple core components including a central core and one or more inner layers. The core assembly may also comprise multiple longitudinally divided components, if desired.

In one embodiment, the apparatus comprises an elongate enclosed cavity within the one or more elongate members, which cavity contains or may contain a mobile material occupying a portion of the cavity. Preferably the elongate member is the elongate contact pad and/or the core supporting member and/or the two laterally disposed elongate members. The elongate enclosed cavity is preferably a sealed internal container, but may be an openable container. The mobile material may be any suitable material capable of moving when the device is tipped or an equivalent change in force is applied. The mobile material may be, for example, a single solid form (e.g. a disc or multiple discs on a rod, or a large ball) or may comprise multiple parts (e.g. marbles) or may be particulate in nature (e.g. sand) or may be a liquid (e.g. water). Optionally, the mobile material is a weight formed on a rod fixedly mounted in the elongate cavity whereby the weight may move along the rod when the apparatus is tipped or other appropriate change in force is applied. Alternatively, the mobile material is sand or other suitable particular material or water (or other non-viscous liquid) which may move along the internal cavity. Preferably, the mobile material is a flowable solid, such as sand. In use, the apparatus of this embodiment may be provided in an upright (i.e. elongate direction upwards) configuration and the user may attempt to 'tackle' the apparatus as if it is another player bringing it to ground in a manner whereby the apparatus is tipped so as to be grounded in a substantially horizontally extended position. During the change in force applied to the apparatus during the 'tackle' or collision, by virtue of tipping and striking the apparatus an equivalent force is applied to the mobile material within the internal cavity. As the player brings the apparatus to rest on the ground, the mobile material is typically caused to continue to move in the direction of the force, which is typically after a tackle along the length of the internal cavity and as it strikes the other end of the internal cavity, the mobile material applies a corresponding force (a supplemental force) to the padded member surrounding it causing it to move further in the direction of the original 'tackle' or collision (a supplemental movement). This makes holding the apparatus during and after the 'tackle' more difficult and somewhat mimics the struggle and effort of a tackled player during the game of American football or rugby. Thus, the apparatus may be useful in training for improved holding technique, or wrapping, and holding strength during and after tackle.

Optionally the amount or weight of mobile material may be variable or adjustable by providing access to open the internal cavity, whereby the power of the supplemental force and quantum of supplemental movement may be varied as desired.

Figure 2:
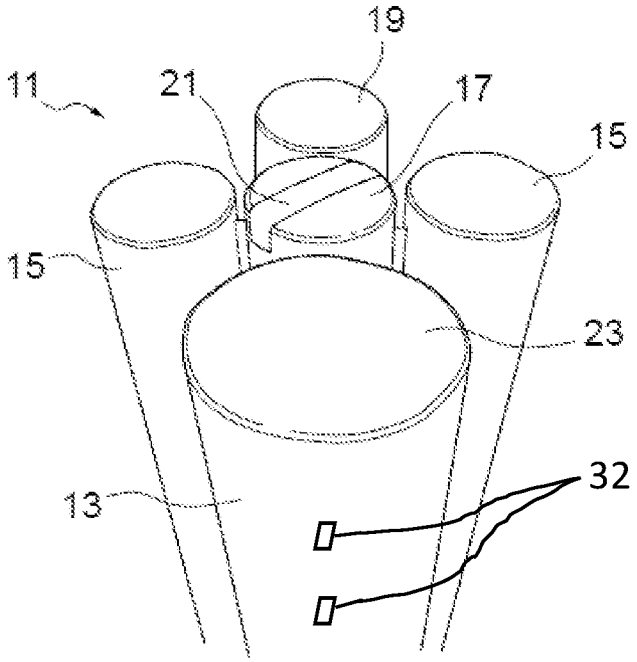
FIG. 2 illustrates in a front, top perspective view an upper portion of a collision training apparatus according to a second embodiment of the invention.

In a further embodiment, applicable to the invention and all the embodiments hereinbefore described, a training apparatus may be further provided with a sensor 32, as best seen in FIG. 2, or arrangement of sensors for measuring, analysing and/or monitoring technique, performance and/or improvement over time.

According to this embodiment, there may be provided sensors 32 at one or various locations about the contact surface of the apparatus, whereby point of contact may be determined, as well as possible additional data relating to duration of contact and strength of contact. Sensors may be provided on the elongate contact pad and the two laterally disposed elongate members in particular to record where contact occurs and also where the wrap and grip takes place and optionally strength and duration of wrap and grip. Optionally, the apparatus is provided with a sensor 32 or device for determining one or more of distance, speed and direction of movement of the apparatus (e.g. accelerometer, gyrometer and/or GPS sensor). Typically, the data generated by the sensor(s) will be transmitted by wireless communication via a receiver to e.g. a microprocessor. The data may then be analysed (e.g. by a software application) to determine factors of performance about the particular user, such as accuracy of hit and power within the initial hit, whether the power was maintained or fell away after initial impact, the strength that was demonstrated and the distance, speed and direction in which the apparatus was moved. Thus the strengths and weaknesses of a particular player's technique can be measured and, for example, a profile created. Thus exercises to improve on weaknesses can be identified, such as through identifying changes that would improve the particular player's technique as well as strength and conditioning programmes to improve the player's performance.

Optionally, the user may have items of clothing, a shirt and headwear for example, configured with sensors to define the points of contact with the apparatus and also the orientation of particular body parts in the approach, during and after contact with apparatus. The apparel sensor data may be combined with the sensor data from the apparatus to give a unique informative data set on both the points of contact on the apparatus but also the points of contact by the user as well as orientation, direction and strength data.

Optionally, the data generated may be configured for graphical representation on a video or animated representation of a user carrying out a tackle in training on the apparatus to illustrate how changes in body shape, approach and technique may improve the tackle. Optionally, the data can be used to simulate tackles in game play to provide predictive outcomes in gameplay from improvements in aspects of the tackle.

Optionally, there may be further sensors (or electronics) to determine the movement achieved.

Analysis can be used to determine improvements in training methods (e.g. to learn about the most efficient techniques and adapt training methods to accommodate them) as well as to adapt coaching on technique to meet a particular player's strengths and weaknesses thus maximizing each individual's potential. Further, methods may be developed for a particular team profile (collection of individual profiles) which may inform the most effective order and timing for joining a collision event or tackle.

Sensors, 32 typically pressure sensors, capable of determining applied pressure as well as, preferably, extent and duration of applied pressure should preferably be placed beneath the surface of the contact surface. Optionally, a multi-cell sensor element may be provided that covers a substantial portion and preferably the entire contact surface may be used and pressure data transmitted to a receiving device (e.g. a microprocessor) typically by wireless communication, where the data is analysed and presented back as output for immediate consumption by the user and/or the coach, e.g. in the form of number, graphs, charts or other visuals to illustrate the performance.

There is thus provided as a further aspect of the invention a training apparatus as described above, characterized in that one or more contact surface and/or gripping feature is configured with one or a plurality of sensors 32 for determining the location, degree and extent of the contact with the contact surface. The location is preferably identified as one or a plurality of portions of the contact surface. By the degree of contact it is meant the strength of contact and by extent of contact it is meant duration (or plot of degree of contact over time). Optionally, the apparatus is provided with one or more sensors 32 to determine the amount and direction of longitudinal and non-longitudinal movement of the apparatus during a tackle or tackle event (from which may be produced, e.g., a plot of position against time). Preferably, the apparatus has one or more further features as hereinbefore described.

In a further aspect, there is provided a program for a computer configured to receive data from such sensors 32 and according to a pre-determined format, provide an output (e.g. as a digital display).

Such data may be further utilized to monitor the improvement of a player over time and also the performance of a coach over time.

In a still further aspect of the invention, there is provided a method of training a person in improved tackle technique, the method comprising: providing a training apparatus as hereinbefore defined, the apparatus configured with one or a plurality of sensors 32 appropriately calibrated for determining the location, degree and extent of the contact with the contact surface; providing a microprocessor in signal communication (e.g. by wireless communication) with the plurality of sensors 32 and programmed to interpret and/or analyse the sensor data; conducting one or a series of contact events in which the person follows a training instruction to contact with a training apparatus; analyzing the data associated with the one or series of contact events generated by the sensors and communicated to the microprocessor; determining weaknesses in the player technique or conditioning level by comparison of sets of the data with pre-determined (or calibrated) sets of target data associated with one or more player techniques or conditioning levels; and producing a technique or conditioning training schedule comprising training elements selected from a pre-determined set of training elements designed to improve certain weaknesses in technique or conditioning level. The person may then undertake training according to the training schedule and then may repeat the method above. Thus a new set of collision event data may be generated which may be compared with existing data sets, such as pre-determined target data (to determine perceived weaknesses), the person's previous data (to determine improvement, over time and of the perceived weaknesses as a result of the targeted training) and team data.

The effectiveness of training method (or technique or conditioning schedules) and/or the effectiveness of the conditioning coach may be assessed by performance measurement. Further, the use of person data in the context of team data may be utilized to plan game play utilizing certain player strengths (e.g. the data may indicate that certain persons in a team are better at certain parts of the tackle event, whilst other persons are better at other parts of the tackle event), which is thus a further method of the invention.

Sets of technique and performance data for persons and teams may be obtained and categorized according to a training exercise. These datasets, which are preferably tagged with surface condition data (e.g. if the ground is in a similar condition) may be used to assess improvement in individual and team technique, performance and conditioning, to assess effectiveness of training or conditioning (and training and conditioning coaches) and to plan most advantageous game play for a team.

The invention will now be described in more detail, without limitation, with reference to the accompanying Figures.

In FIG. 1, a training apparatus 1 according to one embodiment for use in training of the 'grapple' tackle comprises five cylindrical members 3,5,7,9. Since all five cylindrical members 3,5,7,9 are the same diameter in the apparatus 1 as shown, then any of cylindrical members 3,5,9 can be the contact pad, but here the contact pad is designated as cylindrical member 3. To the rear of contact pad 3, but adjacent and adjoined thereto, is cylindrical support member 7. Disposed either side of the cylindrical support member 7 and extending laterally beyond the lateral extent of contact pad 3, when viewed from the front or contact face, are laterally disposed elongate members 5. Stabilising cylindrical member 9 is adjacent to and attached to the rear of support member 7.

Each cylinder 3,5,7,9 is a resiliently compressible foam cylinder with a fabric and polymer cover. The covered cylinders 3,5,7,9 are stitched together so that the cylinders 3, 5 and 9 are all stitched to support cylinder 7. The cylinders 3,5,7,9 shown in FIG. 1 are all 200 mm (7.87 in in diameter and have a height of 1100 mm (43.31 in).

In use, a player in training would approach the apparatus 1 from the front side toward a contact face of contact pad 3, with a view to contacting their shoulder with the front face of contact pad 3 and their head to either side of the contact pad 3. The player should attempt to grab the two laterally disposed members 5 (or grapple members) by stretching their arms to wrap around the laterally disposed members 5 and holding on. In view of both the total width defined by the size and positions of the two lateral members 5 (which will be 600 mm (23.62 in)) makes it a challenging arm wrap for the player to make and maintain (and also represents the position of the arms of a typical rugby player). The configuration of the cylinders 5,7 is such that the laterally disposed members 5 can be pulled toward the user during the training exercise while wrapping and gripping. The user then aims to move and/or topple and floor the apparatus 1 while maintaining strength in the wrap about laterally disposed members 5, which is the technique that particularly benefits from this exercise and represents an advantage in the game of Rugby.

Figure 3:
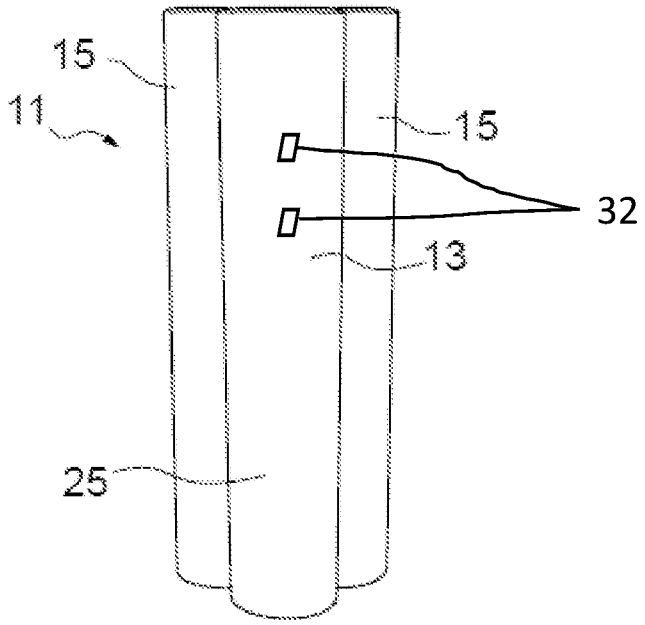
FIG. 3 illustrates a front view of a collision training apparatus of FIG. 2.
Figure 4:
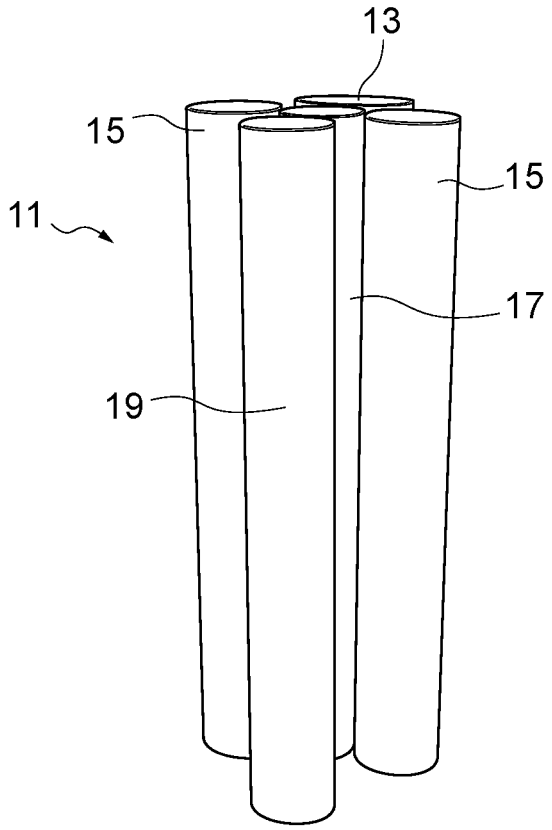
FIG. 4 illustrates a rear side view of a collision training apparatus of FIG. 2.

In FIG. 2, an alternative embodiment has training apparatus 11 again for use in training of the 'grapple' tackle. The same apparatus is shown in FIGS. 3 and 4 from a front and rear view respectively. Apparatus 11 comprises five cylindrical members 13,15,17,19. Of these five, one pad, the contact pad 13 has a larger diameter than the remaining cylindrical members 15,17,19. Behind and adjacent to contact pad 13 is core support member 17, which is provided with a handle 21 on its top surface for use by a trainer. Attached either side of the core support member 17 are laterally disposed members 15 and to the rear of the core support member 17 is stabilising member 19 which facilitates stability when in standing position (but also introduces instability during the tackle, which is an additional training feature).

The contact pad 13 is in a different colour to the remaining pads to assist in identification during the tackle approach. The contact pad 13 has a diameter of 300 mm (11.81 in), being the width of surface 23, while the remaining members 15,17,19 have a diameter of 200 mm (7.87 in). Thus the laterally disposed members 15 are disposed along a plane centred through the laterally disposed members 15 that is 400 mm (15.75 in) behind a front contact surface 25 of the contact pad 13. The height of the device as shown is 1100 mm (43.31 in).

The apparatus 11 is used in a similar way to apparatus 1 in FIG. 1. A player approaching the apparatus 11 seeks to contact a shoulder against the front surface 25 of contact pad 13 and at the same time wrap their arms around laterally disposed members 15, which essentially represents the arms of a player they would be tackling in the game of rugby. It is necessary to maintain the strength of the wrap during the course of the tackle from contact through to grounding the apparatus 11. The size and position of the laterally disposed members 15 are such that they extend 150 mm (5.91 in) either side of the contact pad 13. The diameter of laterally disposed members 15 is 200 mm (7.87 in) and as such is a difficult grip too. During the tackle, the user maintains the wrap and optional grip to and including the process of moving and/or toppling and flooring the apparatus 1.

In FIG. 3, front contact surface 25 of contact pad 13 is shown with the lateral extent of laterally disposed members 25 apparent. In FIG. 4, a rear perspective view illustrates how laterally disposed member 15 is affixed to core member 17 and shows stabilising member 19 at the rear.

The invention has been described with reference to a preferred embodiment. However, it will be appreciated that variations and modifications can be effected by a person of ordinary skill in the art without departing from the scope of the invention.

The invention claimed is:

1. A training apparatus for use in tackle training, the apparatus comprising:

an elongate contact pad having a front surface; and at least two laterally extending elongate members disposed in general longitudinal alignment with the elongate contact pad, wherein the laterally extending elongate members are disposed to the rear of the elongate contact pad, wherein the at least two laterally extending elongate members and elongate contact pad are disposed about and secured to a core elongate supporting member, wherein the at least two laterally extending elongate members are moveable relative to the core elongate supporting member, and wherein the elongate contact pad has a larger width or diameter than each of the at least two laterally extending elongate members and the elongate core supporting member.

2. The training apparatus as claimed in claim 1, wherein the elongate contact pad has a lateral width and the at least two laterally extending elongate members each extend laterally beyond the elongate contact pad.

3. The training apparatus as claimed in claim 2, wherein the elongate contact pad has a lateral width of from 20 cm (7.87 in) to 40 cm (15.75 in).

4. The training apparatus as claimed in claim 1, wherein the elongate contact pad is cylindrical or partially cylindrical.

5. The training apparatus as claimed in claim 1, wherein the at least two laterally extending elongate members are disposed to define a cumulative lateral extent of at least 1.5× a width of the elongate contact pad.

6. The training apparatus as claimed in claim 1, wherein the at least two laterally extending elongate members are centred about a position from 25 cm (9.84 in) to 50 cm (19.69 in) to the rear of the front surface of the elongate contact pad.

7. The training apparatus as claimed in claim 1, wherein the at least two laterally extending elongate members have a depth from front to rear, in a portion laterally disposed beyond the elongate contact pad, of from 10 cm (3.94 in) to 25 cm (9.84 in) cm.

8. The training apparatus as claimed in claim 1, wherein the at least two laterally extending members are cylindrical or partially cylindrical.

9. The training apparatus as claimed in claim 1, wherein the core supporting member is cylindrical or partially cylindrical.

10. The training apparatus as claimed in claim 1, wherein the core supporting member has a lateral width of from 15 cm to 25 cm (9.84 in).

11. The training apparatus as claimed in claim 1, wherein the core supporting member has a depth, from front to back, of from 10 cm to 25 cm (9.84 in).

12. The training apparatus as claimed in claim 1, which comprises an elongate contact pad member, two laterally extending elongate members and an elongate core supporting member, wherein one or more of the elongate contact pad, the two laterally extending elongate members and the elongate core supporting member comprises one or more of:

A) a movable guiding flange member disposed about the surface thereof which is capable of being moved to multiple longitudinal positions along the length of the one or more elongate members;

B) an elongate enclosed cavity within the one or more elongate members, which cavity contains or may contain a mobile material occupying a portion of the cavity; and C) an interchangeable core, core assembly or internal layer of the one or more elongate members whereby the elongate member is configured such that one or more core elements or internal layers may be removed from the elongate member and substituted with alternative core elements or internal layers having alternative features.

13. The training apparatus as claimed in claim 1, which comprises an elongate contact pad member, two laterally extending elongate members and an elongate core supporting member, wherein each of the elongate contact pad member, the two laterally extending elongate members and the elongate core supporting member are formed of a foam material.

14. The training apparatus as claimed in claim 1, which comprises an elongate contact pad member, two laterally extending elongate members and an elongate core supporting member, wherein each of the elongate contact pad member, the two laterally extending elongate members and the elongate core supporting member are cylindrical.

15. The training apparatus as claimed in claim 1, which comprises an elongate contact pad member, two laterally extending elongate members and an elongate core supporting member, wherein each of the elongate contact pad member, the two laterally extending elongate members and the elongate core supporting member are mobile or moveable relative to one another within a flexible outer coating or flexible case.

16. The training apparatus as claimed in claim 1, wherein the elongate contact pad member, the at least two laterally extending elongate members and the elongate core supporting member are provided in a single flexible outer coating or outer cover.

17. The training apparatus as claimed in claim 1, wherein each of the elongate contact pad member, the at least two laterally extending elongate members and the elongate core supporting member are provided with an individual flexible outer coating or flexible cover.

18. The training apparatus as claimed in claim 17, wherein the individually coated or covered elongate contact pad member, at least two laterally extending elongate members and elongate core supporting member are stitched together and separated by a length of flexible outer coating or flexible cover material.

19. The training apparatus as claimed in claim 1, wherein there is disposed to the rear of the elongate core supporting member one or more stabilizing members.

20. The training apparatus as claimed in claim 19, wherein the one or more stabilizing members are elongate cylindrical stabilizing members.

21. The training apparatus as claimed in claim 20, wherein there is just a single elongate stabilizing member disposed to the rear of the elongate core supporting member.

22. The training apparatus as claimed in claim 1, which comprises an arrangement of five cylindrical members, each cylindrical member mounted adjacent to at least one other cylindrical member, wherein at least one cylindrical member is the elongate contact pad and at least two cylindrical members are the at least two laterally extending elongate members.

23. The training apparatus as claimed in claim 1, wherein the elongate contact pad is cylindrical and has a diameter of from 25 (9.84 in) to 35 cm (13.78 in), the elongate core supporting member is cylindrical and has a diameter of from 15 (5.91 in) to 25 cm (9.84 in), the elongate contact pad being moveable relative to the elongate core supporting member, wherein the at least two laterally extending elongate members comprise two laterally extending cylindrical members having a diameter of from 15 (5.91 in) to 25 cm (9.84 in) and wherein the training apparatus further comprises an elongate cylindrical stabilizing members disposed to the rear of the elongate core supporting member and moveable relative thereto and having a diameter of from 15 (5.91 in) to 25 cm (9.84 in).

24. The training apparatus as claimed in claim 1, wherein the elongate contact pad and optionally the at least two laterally extending elongate members are provided with sensors to record point of contact and optionally strength and duration of contact.

25. The training apparatus as claimed in claim 1, wherein the elongate contact pad comprises distinguishing indicia.

* * * * *